US005758423A

United States Patent [19]

Eversole et al.

[11] Patent Number: 5,758,423

[45] Date of Patent: Jun. 2, 1998

[54] EDGE TRIMMER

[75] Inventors: Billie E. Eversole, Roanoke; Ronald W. Kessinger, Moneta, both of Va.

[73] Assignee: Berk, L.L.C., Roanoke, Va.

[21] Appl. No.: 694,362

[22] Filed: Aug. 9, 1996

[51] Int. Cl.[6] ..... B26B 29/00

[52] U.S. Cl. ..... 30/279.2; 30/280; 30/287; 30/294

[58] Field of Search ..... 30/278, 279.2, 30/280, 286, 287, 294, 481

[56] References Cited

U.S. PATENT DOCUMENTS

| | | | |
|---|---|---|---|
| 3,068,569 | 12/1962 | Campbell, Jr. | 30/294 |
| 3,644,993 | 2/1972 | Chupp | 30/280 |
| 3,934,341 | 1/1976 | Carlson | 30/287 |
| 4,064,627 | 12/1977 | Zanfini | 30/287 |
| 4,495,697 | 1/1985 | Ruff | 30/287 X |
| 4,667,409 | 5/1987 | D'Amato | 30/287 X |
| 4,777,724 | 10/1988 | Sirchia | 30/287 |
| 5,044,078 | 9/1991 | Heaton, Sr. | 30/280 X |
| 5,285,575 | 2/1994 | Hirano | 30/278 X |
| 5,410,813 | 5/1995 | Carlson | 30/287 |
| 5,561,905 | 10/1996 | Sherman | 30/280 |

OTHER PUBLICATIONS

Packaging material for "Rabonor Edge Trimming Plane", No Date.

Packaging material for "Fortuna Double Edge Trimmer", No Date.

Advertisement material for "Adwood Edge Trimming Knife", No Date.

Advertisement material for "ATI End & Edge Trimmer", No Date.

Constantine catalogue, p. 14, No Date.

Woodcraft Supply catalogue, p. 101, No Date.

Woodworker's Supply catalogue, p. 19, No Date.

*Primary Examiner*—Eugenia Jones

*Attorney, Agent, or Firm*—Kenyon & Kenyon

[57] ABSTRACT

An edge trimmer for removing excess edgebanding includes a retainer plate and a guide rail which assemble to hold a beveled, single-edged cutting blade. The retainer plate has a slot to accommodate and guide the excess edgebanding. In addition, the retainer plate has a recessed blade tray which receives the cutting blade and spans at least a portion of the slot. A removable fastener holds the retainer plate and guide rail together.

6 Claims, 4 Drawing Sheets

EDGE TRIMMER

FIELD OF THE INVENTION

The present invention relates to edge trimmers and more specifically to a hand tool for trimming excess edgebanding.

BACKGROUND OF THE INVENTION

Several edge trimmers are currently available, however, they fail to offer a combination of low cost, easily replaceable and inexpensive blades, durability and ability to handle a variety of edging widths. For example, an edge trimming knife available from Adwood Corporation in High Point, N.C. is a single edge trimmer that has a unitary body which holds a special blade. The blade is designed with U-shaped slots, must be resharpened and is expensive to replace. In a similar manner, several other edge trimmers are available which depend on the use of specially designed blades which are relatively expensive and may require return to the manufacturer to get the blades resharpened.

Double edge trimmers are also available which can simultaneously trim both sides of edgebanding. However, in addition to the limitations discussed above, these trimmers are limited in the width of the edgebanding which can be trimmed.

SUMMARY OF THE INVENTION

An edge trimmer is provided which is capable of trimming excess edgebanding materials that have been applied to panels, boards, shelving, etc. The edge trimmer includes a retainer plate and a guide rail. The retainer plate has at least one open-ended slot which is configured to accept an edgebanding material which will be trimmed. In addition, the retainer plate has a surface positioning area that rests on the surface of the panel, board, shelving, etc. to support and guide movement of the edge trimmer as the edgebanding is trimmed. The guide rail has a guide surface which rests against an outer surface of the edgebanding to guide movement of the edge trimmer as the edgebanding is trimmed. At least one cutting blade is secured between the retainer plate and guide rail so that the cutting blade acts to trim an edgebanding as the edge trimmer is moved along the edge of an article to which an edgebanding has been applied.

DETAILED DESCRIPTION OF THE PREFERRED EMBODIMENT

The edges of shelves, boards, panels and other similar materials are frequently trimmed with edgebanding materials to provide a suitable finished edge on the product for a variety of applications. However, the dimensions of the edgebanding material may exceed the dimensions of the edge surface to which the edgebanding is being applied, resulting in excess material extending beyond the edge surface. In order to obtain a finished product, it is usually necessary to trim off this excess material.

Figure 1:
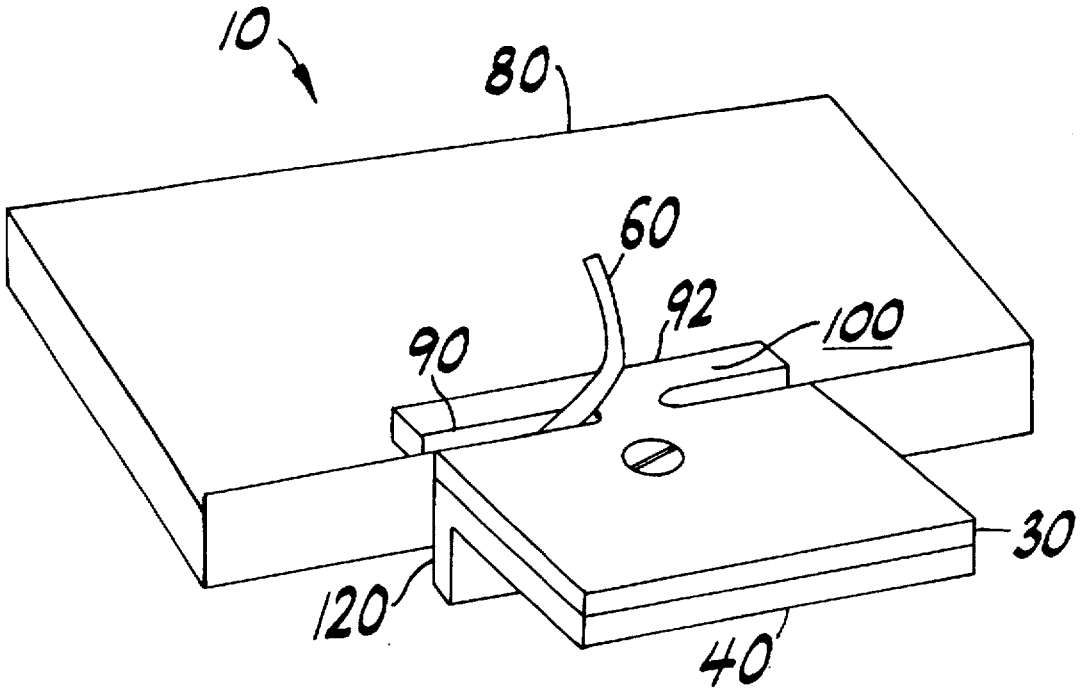
FIG. 1 is a perspective view of an edge trimmer.
Figure 2:
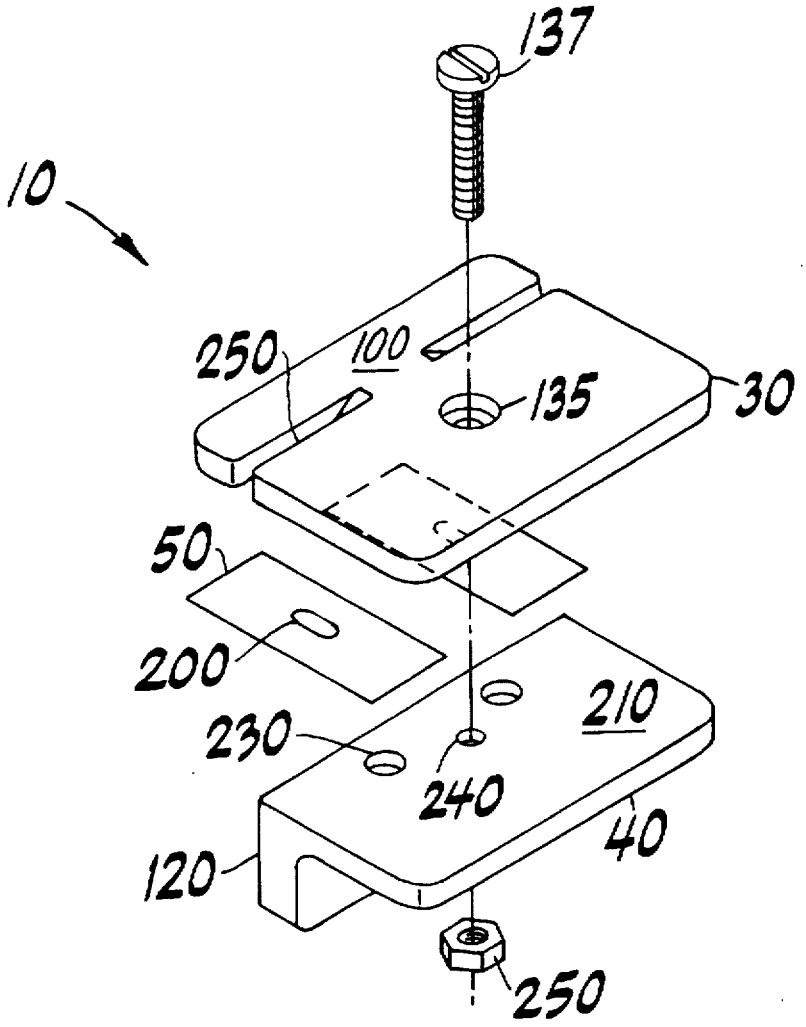
FIG. 2 is an exploded view of the edge trimmer of FIG. 1.
Figure 3:
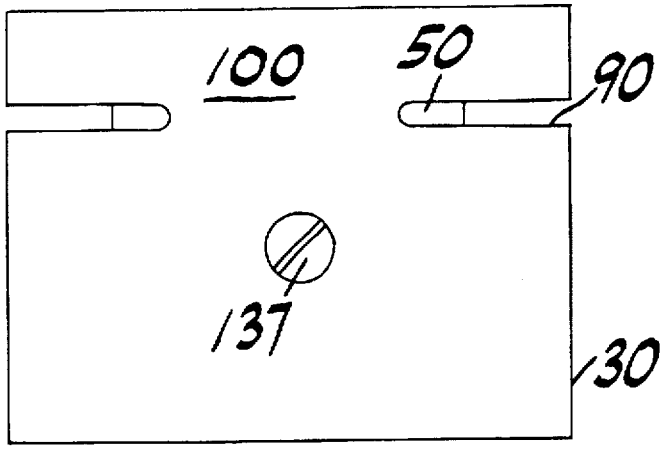
FIG. 3 is a top view of an edge trimmer.

As shown in FIGS. 1 and 2, an edge trimmer 10 for trimming and removing excess edgebanding material is comprised of a retainer plate 30 and a guide rail 40 which are assembled to hold a cutting blade 50. Such a device is capable of trimming the excess portion 60 of edgebanding materials 70 that have been applied to panels, boards, shelving, etc. 80. The retainer plate 30 has an open-ended slot 90 which is configured to accept the excess portion of edgebanding material 60 which will be trimmed. In addition, the retainer plate 30 has surface positioning area 100 that rests on the surface of the panel, board, shelving, etc. to support and guide movement of the edge trimmer 10 as the excess edgebanding 60 is trimmed. The guide rail 40 has a guide surface 120, at least a portion of which rests against an outer surface of the edgebanding 70 to guide movement of the edge trimmer 10 as the excess edgebanding 60 is trimmed. The cutting blade 50 is secured between the retainer plate 30 and guide rail 40 so that the cutting blade 50 acts to trim the excess edgebanding 60 as the edge trimmer 10 is moved along the edge of an article 80 to which an edgebanding 70 has been applied.

Figure 4:
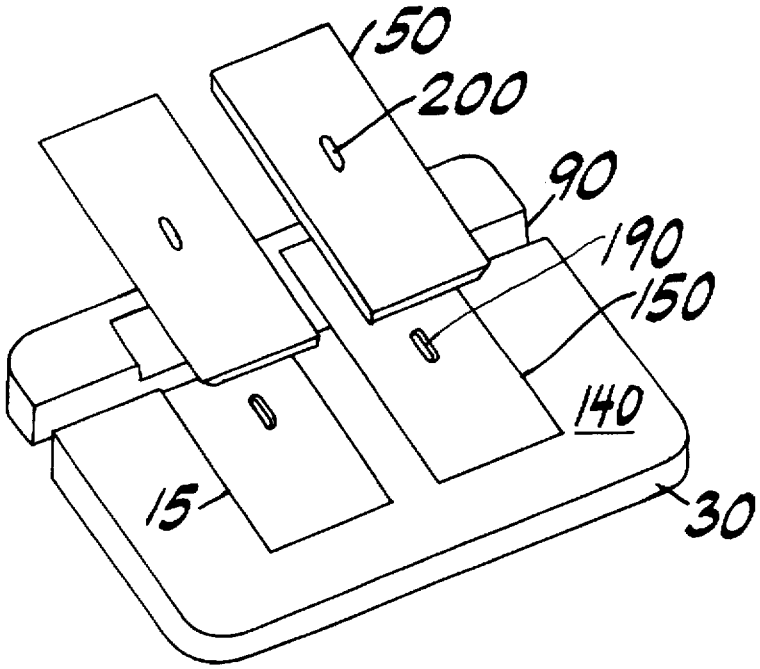
FIG. 4 is a perspective view of the inner surface of a retainer plate of the edge trimmer.
Figure 5:
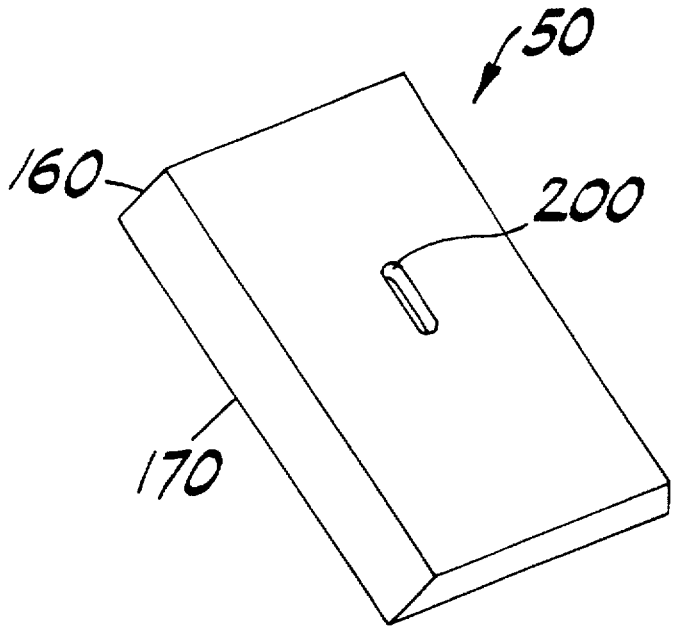
FIG. 5 is a perspective view of a cutting blade.

In a preferred embodiment, as shown in FIGS. 1–4, the retainer plate 30 has two open-ended slots 90 which are axially aligned along an inner edge 92 of the retainer plate. The retainer plate 30 also has two blade trays 150 and a hole 135 to accommodate passage of a bolt 137. The inner surface 140 of the retainer plate 30 is substantially planar. However, as shown in FIG. 4, the blade trays 150 are recessed areas formed in the inner surface 140 of the retainer plate 30 and sized to accept a cutting blade 50, such as a 0.012×0.75×1.75 in. mat cutter blade. The blade trays 150 are located such that they each span at least a portion of a corresponding slot 90 so that each cutting blade 50 also spans at least a portion of the corresponding slot 90 when the cutting blades 50 are positioned and secured in the blade trays 150. The blade trays 150 are sized to be only slightly larger than the cutting blades 50 in order to securely hold and position the blades 50 when the edge trimmer 10 is assembled. For example, the blade trays 150 can be within +/−0.003 in. of the dimensions of the cutter blade 50. Preferably, the cutting blades 50 each have a single beveled edge 160 as shown in FIG. 5, and are readily available in craft, hardware and hobby stores. In assembling the edge trimmer 10, each cutting blade 50 is positioned in a corresponding blade tray 150 so that the beveled surface of each cutting blade faces the inner surface 140 of the retainer plate, and the cutting edge 170 of each blade faces the open end of the corresponding slot. The flat surface of each cutting blade 50 should be substantially even with the inner surface 140 of the retainer plate 30. The blade trays 150 may have a post 190 which is configured to fit within an opening 200 in the cutting blade. The use of such a post 190 provides additional stability of the blade 50 in the blade tray 150 during use, and helps prevent the retainer plate 30 and the guide rail 40 from rotating relative to each other.

As shown in FIG. 2, the guide rail 40 is generally L-shaped and has a substantially planar upper surface 210 and a substantially vertical guide surface 120. When each of the blade trays 150 has a post 190, the upper surface 210 of the guide rail 40 has corresponding post holes 230 sized and positioned to accept the posts 190 when the edge trimmer 10 is assembled. In addition, the guide rail 40 has a hole 240 to accommodate the bolt 137. The hole 240 is positioned to align with the hole 135 in the retainer plate 30 when the edge trimmer is assembled. The guide rail is configured such that upon assembly of the edge trimmer, the substantially vertical guide surface 120 of the guide rail 40 is aligned with the outer wall 250 of the slot 90. This ensure that the edge trimmer maintains a proper cutting position as it moves along the edge to be trimmed.

To assemble the edge cutter 10, cutting blades 50 are positioned in corresponding blade trays 150 so that the beveled edge surface 160 of each blade faces the surface 140 of the retainer plate and the cutting edge 170 of each blade faces open end of a corresponding slot 90. The guide rail 40 is then placed on the retainer plate 30 so that the upper surface 210 of the guide rail 40 faces the inner surface 140 of the retainer plate 30, and the hole 240 in the guide rail is aligned with the hole 135 in the retainer plate. Also, if present, the posts 190 in the guide rail will fit into the corresponding post holes 230 of the guide rail. A bolt 137 is then inserted through both holes 135, 240 and a nut 250 is threaded on the end of the bolt and tightened to secure the retainer plate 30 and the guide rail to each other. To change a cutting blade 50, the bolt 137 is removed to enable separation of the retainer plate 30 and guide rail 40. The blade 50 is then removed and replaced.

This edge trimmer is easy to manufacture and assemble, and permits quick installation and replacement of cutting blades. Also, this embodiment having two axially aligned slots 90 with their corresponding cutting blades 50, permits the edge trimmer to be used in a reversible manner along an edgebanding, and also facilitates its use by left-handed persons. The edge trimmer is also capable of accommodating most edging widths and can accomodate thicknesses up to about 3 mm (⅛ in.), when the edge trimmer is designed to hold 0.012×0.75×1.75 in. cutter blades. However, various other sizes of blades can be used in the edge trimmer. A further advantage of this edge trimmer is that the blades 50 in each blade tray 150 can be switched with each other so that unused areas on each blade are exposed in their respective slots 90.

Figure 6:
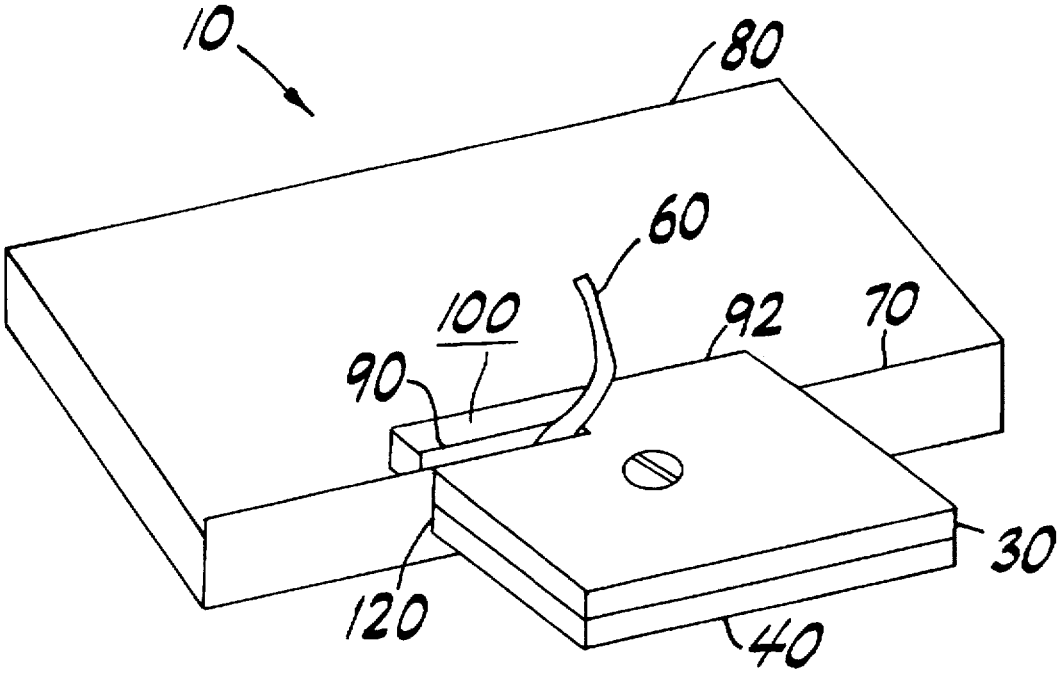
FIG. 6 is a perspective view of another embodiment of an edge trimmer according to the present invention.

As shown in FIG. 6, in an alternate embodiment of the present invention, the retainer plate 30 has only one open-ended slot with a single blade tray 150 to hold a single cutting blade 50. In addition, the inner edge 260 of the guide rail 40 can be made without a vertical leg extension as long as the inner edge 260 has sufficient height to remain in guiding contact with the edgebanding as the edge trimmer is moved along the face of the edgebanding.

The retainer plate 30 and guide rail 40 can be made from any suitably rigid material including metal, plastic or wood. Although the slots 90 are shown as highly elongated, they can be shorter, as long as they are configured to accommodate a desired width of edgebanding. The retainer plate 30 and guide rail 40 are shown as fastened by a bolt and nut. However, they may be secured by any suitable, removable fastening means including, but not limited to a clip, clamps or screw.

What is claimed is:

1. An edge trimmer for trimming edgebanding material from a workpiece having an upper surface and an outer surface, said edge trimmer comprising:

a retainer plate having a first open-ended slot near an inner edge of the retainer plate and having a recessed blade tray formed in a substantially planar inner surface of the retainer plate, the blade tray spanning at least a portion of the first slot, said retainer plate including a surface positioning area that rests on the upper surface of the workpiece as the edgebanding material is trimmed;

a guide rail having a substantially planar upper surface and a substantially vertical guide surface which rests against the outer surface of the workpiece as the edgebanding material is trimmed, the guide surface being substantially aligned with an outer wall of the first slot and the guide rail being configured such that it does not block the first slot when the guide rail is fastened to the retainer plate;

a cutting blade having a beveled surface and a cutting edge, said cutting blade being disposed in the blade tray such that said beveled surface faces the inner surface of the retainer plate and said cutting edge faces the open end of said open-ended slot; and a removable fastener which securely fastens the retainer plate to the guide rail such that the inner surface of the retainer plate engages the upper surface of the guide rail.

2. The edge trimmer of claim 1, wherein the blade tray has a post and the upper surface of the guide rail has a corresponding post hole such that when the retainer plate and guide rail are fastened, the post in the blade tray fits into the post hole of the guide rail.

3. The edge trimmer of claim 2, wherein the substantially vertical guide surface of the guide rail is a vertically extending leg.

4. The edge trimmer of claim 3, wherein the retainer plate has a bolt hole and the guide rail has a corresponding bolt hole; and, said removable fastener comprises a bolt which is disposed through the bolt hole of the retainer plate and the bolt hole of the guide rail, and a nut which is threaded onto an end of the bolt to securely fasten the retainer plate to the guide rail.

5. The edge trimmer of claim 4 wherein:

said retainer plate has a second open-ended slot which is axially aligned with the first slot;

said retainer plate has a second blade tray spanning at least a portion of said second slot, said second blade tray having a post; and the guide rail has a second post hole corresponding to the post in said second blade tray.

6. An edge trimmer for trimming edgebanding material from a workpiece having an upper surface and an outer surface, said edge trimmer, comprising:

a retainer plate having two open-ended slots axially aligned near an inner edge of the retainer plate and having two recessed blade trays formed in a substantially planar inner surface of the retainer plate, said retainer plate including a surface positioning area that rests on the upper surface of the workpiece as the edgebanding material is trimmed, each of the blade trays spanning at least a portion of a corresponding slot, and each of the blade trays having a post, the retainer plate having a bolt hole;

a guide rail having a substantially planar upper surface, and having a bolt hole and two post holes, wherein the guide rail is configured such that it does not block the slots when the guide rail is fastened to the retainer plate, the guide rail having a vertically extending guide surface which is substantially aligned with an outer wall of said open-ended slots and which rests against the outer surface of the workpiece as the edgebanding material is trimmed;

two single-edged cutting blades, each cutting blade having a beveled surface and a cutting edge, each cutting blade disposed in a corresponding blade tray such that the beveled surface of each cutting blade faces the inner surface of the retainer plate and the cutting edge of each cutting blade faces the open end of a corresponding open-ended slot;

a bolt which is disposed through the bolt hole of the retainer plate and the bolt hole of the guide rail; and a nut which is threaded onto an end of the bolt to securely fasten the retainer plate to the guide rail such that the inner surface of the retainer plate engages the upper surface of the guide rail and the posts in the blade trays fit into the post holes of the guide rail.

* * * * *